US010781778B2

(12) United States Patent
Haupt et al.

(10) Patent No.: US 10,781,778 B2
(45) Date of Patent: Sep. 22, 2020

(54) HIGH-PRESSURE FUEL PUMP

(71) Applicant: Continental Automotive GmbH, Hannover (DE)

(72) Inventors: Detlef Haupt, Regenstauf / Steinsberg (DE); Yavuz Kurt, Roding (DE); Bernd Wöllisch, Chamerau (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 118 days.

(21) Appl. No.: 16/072,058

(22) PCT Filed: Jan. 23, 2017

(86) PCT No.: PCT/EP2017/051274
§ 371 (c)(1),
(2) Date: Jul. 23, 2018

(87) PCT Pub. No.: WO2017/129504
PCT Pub. Date: Aug. 3, 2017

(65) Prior Publication Data

US 2019/0032615 A1 Jan. 31, 2019

(30) Foreign Application Priority Data

Jan. 26, 2016 (DE) ..... 10 2016 201 082

(51) Int. Cl.
*F02M 55/04* (2006.01)
*F02M 59/46* (2006.01)
(Continued)

(52) U.S. Cl.
CPC ..... *F02M 55/04* (2013.01); *F02M 59/025* (2013.01); *F02M 59/466* (2013.01);
(Continued)

(58) Field of Classification Search
CPC ..... F02M 2200/315; F02M 55/04; F02M 59/102; F02M 59/366; F02M 59/466;
(Continued)

(56) References Cited

U.S. PATENT DOCUMENTS 6,062,830 A 5/2000 Kikuchi et al. ..... 417/540
6,135,093 A 10/2000 Kikuchi et al. ..... 123/467
(Continued)

FOREIGN PATENT DOCUMENTS

DE 19907869 A1 9/1999 ..... F02M 55/04
DE 10218501 A1 4/2003 ..... F02M 55/04
(Continued)

OTHER PUBLICATIONS

German Office Action, Application No. 102016201082.4, 7 pages, dated Dec. 8, 2016.
(Continued)

*Primary Examiner* — Dominick L Plakkoottam
(74) *Attorney, Agent, or Firm* — Slayden Grubert Beard PLLC

(57) ABSTRACT

Various embodiments may include a high-pressure fuel pump with: a pump housing including a pressure chamber and a pump piston movable up and down within the pressure chamber along a movement axis; and a low-pressure damper including a damper volume arranged on the pump housing and damper elements distributed symmetrically around a damper longitudinal axis. The damper longitudinal axis is arranged at an angle of between 5° and 175° in relation to the movement axis.

9 Claims, 2 Drawing Sheets

(51) Int. Cl.

| | |
|---|---|
| ***F02M 59/02*** | (2006.01) |
| ***F02M 59/48*** | (2006.01) |
| *F02M 59/44* | (2006.01) |
| *F04B 53/00* | (2006.01) |
| *F04B 53/16* | (2006.01) |

(52) U.S. Cl.
CPC ..... *F02M 59/48* (2013.01); *F02M 59/44* (2013.01); *F02M 59/445* (2013.01); *F02M 2200/31* (2013.01); *F02M 2200/315* (2013.01); *F04B 53/004* (2013.01); *F04B 53/16* (2013.01)

(58) Field of Classification Search
CPC ..... F02M 2200/04; F02M 2200/31; F02M 59/20; F02M 59/447; F02M 59/48; F02M 63/0225; F02M 63/023; F02M 63/0265; F04B 11/0008; F04B 11/0033; F04B 37/12; F04B 53/004; F04B 53/16
See application file for complete search history.

(56) References Cited

U.S. PATENT DOCUMENTS

| | | | | |
|---|---|---|---|---|
| 6,213,094 | B1 * | 4/2001 | Onishi | F02M 59/462 123/447 |
| 6,647,963 | B2 * | 11/2003 | Onishi | F02M 55/04 123/446 |
| 8,430,655 | B2 * | 4/2013 | Kobayashi | F02M 59/102 417/540 |
| 2007/0020131 | A1 * | 1/2007 | Schroeder | F02M 59/04 417/521 |
| 2010/0209274 | A1 * | 8/2010 | Oikawa | F04B 37/12 417/540 |
| 2017/0023165 | A1 * | 1/2017 | Fujita | F16L 55/04 |

FOREIGN PATENT DOCUMENTS

| | | | | |
|---|---|---|---|---|
| DE | 10327408 | A1 | 4/2004 | F02M 37/00 |
| DE | 102007038426 | A1 | 2/2009 | F02M 55/04 |
| EP | 3121435 | A1 | 1/1917 | F02M 37/00 |
| EP | 0950809 | A2 | 10/1999 | F02M 55/02 |
| EP | 0961023 | A2 | 12/1999 | F02M 55/04 |
| EP | 1365142 | A2 | 11/2003 | F02M 55/00 |
| JP | 1182233 | A | 3/1999 | F02M 55/02 |
| JP | 11159416 | A | 6/1999 | F02M 55/00 |
| JP | 11280602 | A | 10/1999 | F02M 59/44 |
| JP | 2004138071 | A | 5/2004 | F02M 37/00 |
| JP | 2006214301 | A | 8/2006 | F02M 59/44 |
| JP | 2013167257 | A | 8/2013 | F02M 55/00 |
| WO | 2017/129504 | A1 | 8/1917 | F02M 59/48 |

OTHER PUBLICATIONS

International Search Report and Written Opinion, Application No. PCT/EP2017/051274, 24 pages, dated Mar. 23, 2017.

* cited by examiner

HIGH-PRESSURE FUEL PUMP

CROSS-REFERENCE TO RELATED APPLICATIONS

This application is a U.S. National Stage Application of International Application No. PCT/EP2017/051274 filed Jan. 23, 2017, which designates the United States of America, and claims priority to DE Application No. 10 2016 201 082.4 filed Jan. 26, 2016, the contents of which are hereby incorporated by reference in their entirety.

TECHNICAL FIELD

The present disclosure relates to internal combustion engines. Various embodiments may include a high-pressure fuel pump for applying high pressure to a fuel in a fuel injection system of an internal combustion engine.

BACKGROUND

High-pressure fuel pumps in fuel injection systems are used to apply a high pressure to a fuel, wherein the pressure is in the range from 150-400 bar in gasoline internal combustion engines and in the range from 1500-3000 bar in diesel internal combustion engines, for example. The greater the pressure which can be generated in the particular fuel, the lower the emissions which arise during the combustion of the fuel in a combustion chamber, this being advantageous in particular against the background of a reduction in emissions being desired to an ever greater extent. To achieve the high pressures in the particular fuel, the high-pressure fuel pump typically includes a piston pump, wherein a pump piston moves in a translatory manner in a pressure chamber and in the process periodically compresses and relieves the pressure on the fuel contained in the pressure chamber.

Owing to the resulting non-uniform delivery by a piston pump of this kind, fluctuations in the volume flow occur on the low-pressure or intake side of the high-pressure fuel pump, said fluctuations being associated with pressure fluctuations or pressure pulsations in the entire system. These fluctuations can lead to filling losses in the high-pressure fuel pump, as a result of which correct metering of quantities of fuel which are required in the internal combustion engine cannot be ensured. The pressure pulsations, which arise owing to the non-uniform delivery, also cause pump components, for example structural elements such as inflow lines, to vibrate, this potentially creating undesired noise or, in the worst case scenario, even damage to various structural elements. Therefore, high-pressure fuel pumps often have a so-called low-pressure damper which compensates for the fluctuations in the volume flow and therefore reduces the resulting pressure pulsations.

It is known, for example, to use a damping component which operates as a hydraulic storage means which compensates for the fluctuations in the volume flow and therefore reduces the resulting pressure pulsations. For this purpose, deformable damping devices which separate a gas volume from the fuel are installed, for example. If the pressure, for example, in the inflow system increases, the deformable damping device deforms, as a result of which the gas volume is compressed and space is created for the excess fuel. If the pressure drops again at a later point in time, the gas in the gas volume expands again. Known deformable damping devices are, for example, damper capsules made of metal which have two metal diaphragms that are filled with gas and welded at the edges.

SUMMARY

The teachings of the present disclosure may include an improved high-pressure fuel pump comprising a low-pressure damper. For example, a high-pressure fuel pump (10) for applying high pressure to a fuel may include: a pump housing (14) comprising a pressure chamber (34) and a pump piston (22) which moves up and down in a translatory manner in the pressure chamber (34) along a movement axis (24) during operation; and a low-pressure damper (20) comprising a damper volume (40), which is arranged on the pump housing (14), and which low-pressure damper has damper elements (46) which are formed symmetrically around a damper longitudinal axis (32); wherein the damper longitudinal axis (32) is arranged at an angle of between 5° and 175° in relation to the movement axis (24).

In some embodiments, the damper longitudinal axis (32) is arranged substantially perpendicular in relation to the movement axis (24) of the pump piston (22).

In some embodiments, an intersection point (S) of the damper longitudinal axis (32) and of the movement axis (24) is arranged in the pressure chamber (34).

In some embodiments, the damper elements (46) comprise at least one damping device (48), a damper cover (52) which jointly defines the damper volume (40) of the low-pressure damper (20), and a spacer (50) for prestressing the damping device (48), wherein the damper elements (46), in particular along the damper longitudinal axis (32), are arranged in the damper volume (40).

In some embodiments, the pump housing (14) has an inflow region (36) for supplying fuel to the pressure chamber (34) and has a drive region (38) which is situated opposite the pressure chamber (34) along the movement axis (24) of the pump piston (22), drive elements for driving the pump piston (22) being arranged in said drive region, wherein the inflow region (36) and the drive region (38) are fluidically connected to one another by the damper volume (40).

In some embodiments, the pump housing (14) has an inflow region bore (42), which extends substantially parallel in relation to the damper longitudinal axis (32), for connecting the inflow region (36) to the damper volume (40), and has an equalizing bore (44), which extends substantially parallel in relation to the movement axis (24), for connecting the drive region (38) to the damper volume (40), wherein, in particular, both the inflow region bore (42) and also the equalizing bore (44) issue into the damper volume (40) opposite the damper cover (52) along the damper longitudinal axis (32).

In some embodiments, an inlet valve (16) is arranged on the pump housing (14), said inlet valve having a valve axis (26) along which a valve element moves during operation, wherein the valve axis (26) is arranged substantially parallel in relation to the movement axis (24) of the pump piston (22), and in particular coincides with said movement axis.

In some embodiments, the inlet valve (16) is in the form of a digital inlet valve (16) comprising a coil (28) and an electrical plug-in connection (30), wherein the coil (28) and/or the electrical plug-in connection (30) are arranged such that they can be rotated through 360° about the valve axis (26).

In some embodiments, the inlet valve (16) is arranged at the inflow region (36).

In some embodiments, the pump housing (14) is in the form of a forged housing (12).

BRIEF DESCRIPTION OF THE DRAWINGS

Various embodiments are explained in more detail in the following text on the basis of the accompanying drawings, in which.

DETAILED DESCRIPTION

Figure 1:
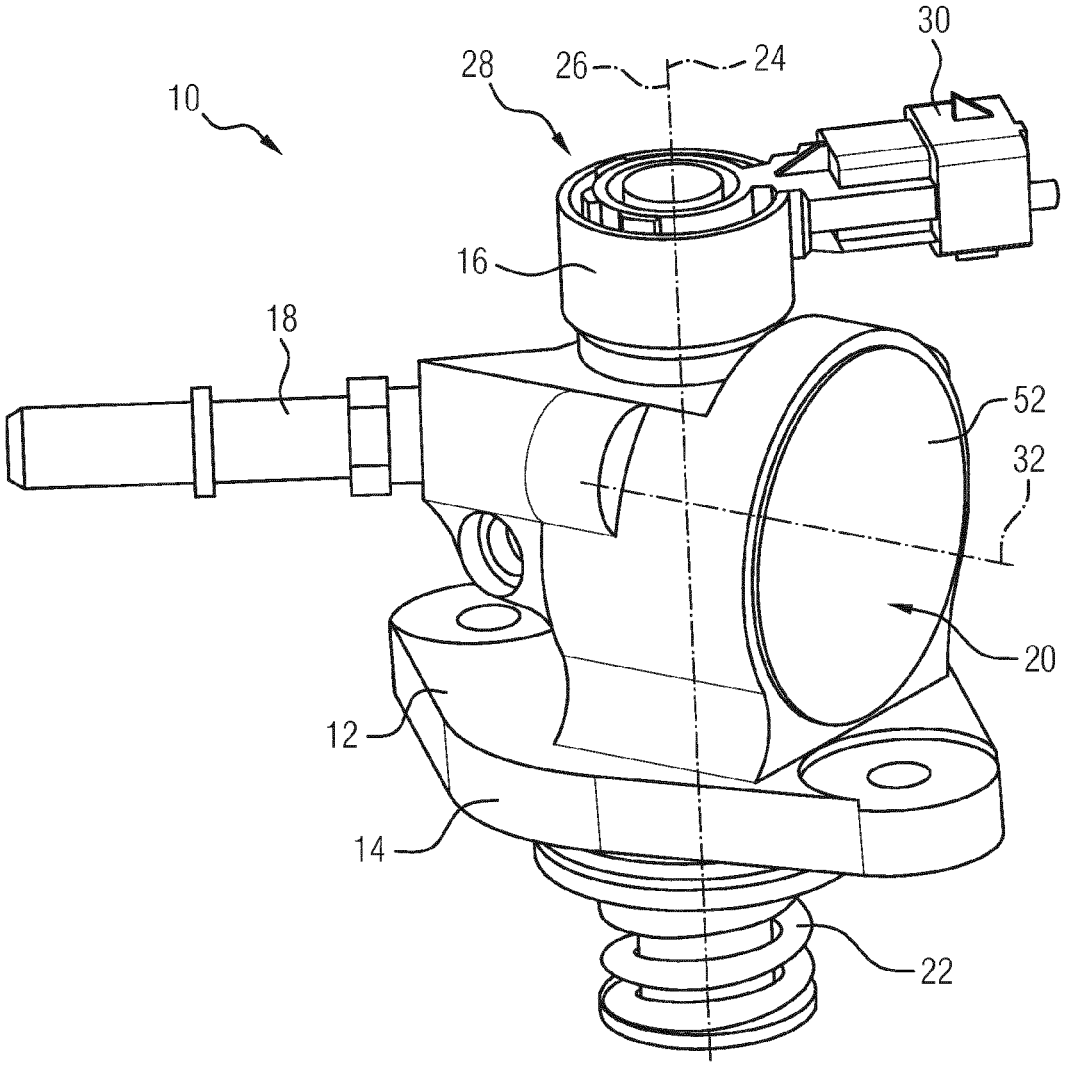
FIG. 1 shows a perspective illustration of a high-pressure fuel pump comprising a low-pressure damper and an inlet valve, according to teachings of the present disclosure.

In some embodiments, a high-pressure fuel pump for applying high pressure to a fuel includes a pump housing comprising a pressure chamber and a pump piston which moves up and down in a translatory manner in the pressure chamber along a movement axis during operation, and also has a low-pressure damper comprising a damper volume which is arranged on the pump housing, wherein the low-pressure damper has damper elements which are formed symmetrically around a damper longitudinal axis. The damper longitudinal axis is arranged at an angle of between 5° and 175° in relation to the movement axis.

In the high-pressure fuel pumps known to date, the low-pressure damper is fitted to an upper end of the pump housing of the high-pressure fuel pump, that is to say said low-pressure damper is situated in line with the movement axis of the pump piston which moves up and down in a translatory manner in the pressure chamber. However, various embodiments herein do not provide the low-pressure damper in line with the pump piston, but rather arrange said low-pressure damper on the side of the pump housing. Accordingly, the low-pressure damper is not arranged on the top of the pump housing, but rather is fitted on the side.

The damper longitudinal axis may be arranged at an angle of between 30° and 120°, preferably 60° and 100°, in relation to the movement axis. In some embodiments, the damper longitudinal axis is arranged substantially perpendicular in relation to the movement axis of the pump piston. In some embodiments, an intersection point of the damper longitudinal axis and of the movement axis is in the pressure chamber. This means that the low-pressure damper is arranged on the side of the pump housing, specifically in such a way that it is level with the pressure chamber on the pump housing.

In some embodiments, the low-pressure damper is arranged offset to the side in relation to the movement axis, depending on the available installation space, and there is therefore no intersection point between the damper longitudinal axis and the movement axis.

In some embodiments, the damper elements have at least one damping device, a damper cover which jointly defines the damper volume of the low-pressure damper, and a spacer for prestressing the damping device, wherein the damper elements, in particular along the damper longitudinal axis, are arranged in the damper volume. In some embodiments, the damping device comprises a damper capsule in which a gas volume is enclosed within two diaphragms. In some embodiments, the spacer comprises an individual component, but it is also possible that said spacer is integrated in the damper cover. In some embodiments, the damping device is arranged closer to the pressure chamber than the damper cover which closes off the low-pressure damper relative to the surrounding area.

In some embodiments, the pump housing includes an inflow region for supplying fuel to the pressure chamber and a drive region situated opposite the pressure chamber along the movement axis of the pump piston. The drive elements for driving the pump piston are in the drive region. The inflow region and the drive region are fluidically connected to one another by the damper volume. The low-pressure damper or the damper volume in the low-pressure damper therefore functions as a distributor point with respect to at least the inflow region and the drive region of the high-pressure fuel pump.

In some embodiments, the pump housing includes an inflow region bore, which extends substantially parallel in relation to the damper longitudinal axis, for connecting the inflow region to the damper volume, and has an equalizing bore, which extends substantially parallel in relation to the movement axis, for connecting the drive region to the damper volume. Here, in particular, both the inflow region bore and also the equalizing bore are designed so as to issue into the damper volume opposite the damper cover along the damper longitudinal axis. In some embodiments, the inflow region bore is on the damper cover, and therefore opposite to the inlet of the equalizing bore into the damper volume. In this case, the inflow region bore can be arranged on the side of or centrally on the damper cover.

The two bores—the inflow region bore and the equalizing bore—can, owing to the clever arrangement of the damper volume on the side and its function as a distributor point, can be configured to be relatively short in comparison to previous high-pressure fuel pumps. As a result, it is possible to generate better damping of pressure pulsations. In some embodiments, owing to the short bores, shorter processing times of these bores are possible. This may result in a significant reduction in costs for producing the pump housing. In addition, the cross sections of said bores can in some cases be configured to be very large, for example by large bore diameters or elongate holes and the like, and as a result better damping properties can be achieved.

In some embodiments, an inlet valve is on the pump housing, said inlet valve having a valve axis along which a valve element moves during operation, wherein the valve axis is arranged substantially parallel in relation to the movement axis of the pump piston. In some embodiments, the valve axis and the movement axis of the pump piston coincide. This means that the inlet valve is now situated at the point of the pump housing at which the low-pressure damper was previously arranged, specifically above the pressure chamber as seen from the drive region.

If the inlet valve comprises a digital inlet valve with a coil and an electrical plug-in connection, and the coil and/or the electrical plug-in connection are provided such that they/it are/is arranged such that they/it can be rotated through 360° about the valve axis, then a greater degree of flexibility or variability can be achieved in respect of the orientation of the electrical plug. In the case of the known design of high-pressure fuel pumps in which the electrode is usually arranged on the side of the pump housing, the coil or the electrical plug-in connection can normally be oriented only laterally, and the inclination is often not possible at least downward in most cases since a large number of interfering contours are usually located here. This means that there is normally only a degree of flexibility of approximately 180° angular range for the orientation. However, owing to the arrangement of the inlet valve on the top of the pump housing, it is now possible to rotate the coil or the electrical plug-in connection through 360°, that is to say a degree of flexibility in an angular range of 360° is produced, wherein attention has to be paid only to the accessibility to flange screws by way of which the pump housing is secured.

In some embodiments, the inlet valve may be arranged at the inflow region. This means that the damper volume functions not only as a distribution point for the inflow region and the drive region, but rather also for further elements through which fuel flows, such as the inlet valve for example.

In some embodiments, the pump housing comprises a forged housing. In forged housings, the corresponding installation space for the low-pressure damper can be provided relatively easily in comparison to a pump housing which is manufactured from a bar material. This is because a required bar diameter might have to be selected to be very large when using bar material and would therefore lead to higher costs for the raw materials of the housing and therefore higher costs as a result of increased effort for mechanical processing. The arrangement of the low-pressure damper on the side of the pump housing is therefore facilitated by using a forged housing.

FIG. 1 shows a perspective illustration of a high-pressure fuel pump 10 which has a pump housing 14 which is in the form of a forged housing 12. An inlet valve 16, an inflow connection 18 for supplying fuel to the high-pressure fuel pump 10, and a low-pressure damper 20 are arranged on the pump housing 14. Furthermore, a pump piston is arranged in the pump housing 14, said pump piston 22, owing to translatory movement along a movement axis 24, compressing and relieving the pressure on the fuel, which is supplied via the inflow connection 18, in the high-pressure fuel pump 10.

As shown in FIG. 1, the inlet valve 16 is arranged along the movement axis 24 in line with the pump piston 22, specifically in such a way that a valve axis 26, along which a valve element, not shown, moves during operation of the inlet valve 16, coincides with the movement axis 24 of the pump piston 22. That is to say that the inlet valve 16 is arranged on the top of the pump housing 14.

In the embodiment shown, the inlet valve 16 is in the form of a digital inlet valve 16 and therefore has a coil 28 and an electrical plug-in connection 30. On account of the inlet valve 16 being arranged on the top of the pump housing, both the coil 28 and also the electrical plug-in connection 30 can be freely rotated in an angular range of 360° about the valve axis 26, which coincides with the movement axis 24. As a result, a flexible arrangement of the coil 28 and/or the electrical plug-in connection 30 on the pump housing 14 is possible.

In some embodiments, the low-pressure damper 20 is arranged on the side of the pump housing 14, specifically in such a way that a damper longitudinal axis 32 is arranged at an angle in relation to the movement axis 24. In the present embodiment, the damper longitudinal axis 32 is arranged substantially perpendicular in relation to the movement axis 24, but it is also possible to provide other angles in a range of from 5° to 175° between the two axes. The arrangement of the low-pressure damper 20 on the side of the housing 14 is shown in greater detail in the sectional illustration in FIG. 2.

It can be seen in the sectional view that the high-pressure fuel pump 10 has a pressure chamber 34 within the pump housing 14, the pump piston 22 moving up and down along the movement axis 24 in a translatory manner in said pressure chamber during operation. Furthermore, bores are provided in the pump housing 14, said bores defining an inflow region 36, via which fuel is supplied from the inflow connection 18 to the pressure chamber 34, and a drive region 38, in which drive elements, not shown, which drive the pump piston 22 during operation are arranged. In this case, the drive region 38 is situated opposite the pressure chamber 34 with respect to the pump piston 22 along the movement axis 24 of the pump piston 22, whereas the inflow region 36 is arranged directly adjacent to the pressure chamber 34.

Figure 2:
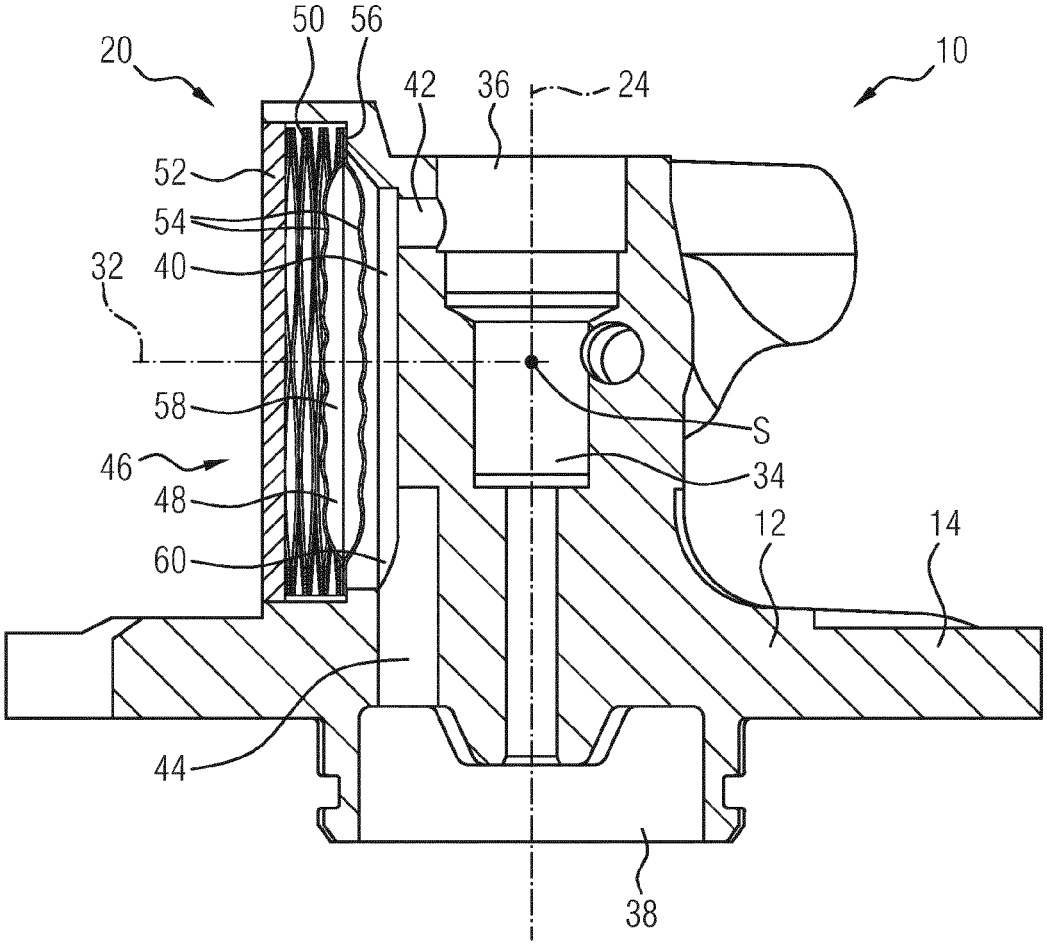
FIG. 2 shows a longitudinal sectional illustration through the high-pressure fuel pump from FIG. 1.

Looking at FIG. 1 and FIG. 2 together, the inlet valve 16 is arranged at the inflow region 36 in order to control the supply of fuel to the pressure chamber 34. As is clear from FIG. 2, the inflow region 36 and the drive region 38 are fluidly connected to one another by a damper volume 40 of the low-pressure damper 20. In this case, the low-pressure damper 20 is arranged on the side of the pump housing 14 so cleverly that bores which connect the damper volume 40 to the inflow region 36 or to the drive region 38 can be configured to be particularly short. These bores are firstly an inflow region bore 42, which connects the inflow region 36 to the damper volume 40, and secondly an equalizing bore 44, which connects the drive region 38 to the damper volume 40.

In some embodiments, such as that shown in FIG. 2, damper elements 46 along this damper longitudinal axis 32 are arranged symmetrically around the damper longitudinal axis 32 within the low-pressure damper 20. The damper elements 46 are essentially at least one damper capsule as damping device 48, at least one spacer 50, and a damper cover 52. In this case, the damping device 48 is formed from two diaphragms 54 which are welded to one another at an edge region 56 and enclose a gas volume 58 between them, so that the damping device 48 is flexible overall and pressure fluctuations, which occur in the damper volume 40 or the inflow region 36 or the drive region 38, can be absorbed by deformation. The spacer 50 is provided in order to stabilize the edge region 56, said spacer applying a prestressing force to this edge region of the damping device 48. The damper volume 40 is jointly defined by the damper cover 52, wherein, in the present embodiment, the pump housing 14 additionally forms a recess 60 which is formed by forging and in which the damper elements 46 are arranged.

As further shown in FIG. 2, the low-pressure damper 20 or the damper volume 40 is arranged on the side of the pump housing 14 such that the damper longitudinal axis 32 around which the damper elements 46 are symmetrically arranged intersects the movement axis 24 of the pump piston 22 at the intersection point S in the pressure chamber 34. This means that the damper volume 40 is located level with the pressure chamber 34 as seen along the movement axis 24, this being particularly advantageous in respect of the available installation space.

It is further shown in FIG. 2 that the inflow region bore 42 and the equalizing bore 44 issue into the damper volume 40 opposite the damper cover 52. However, in this case, the two bores 42, 44 are not oriented in the same way in respect of their longitudinal extent, but rather are arranged substantially perpendicular in relation to one another. Therefore, the inflow region bore 42 extends substantially parallel in relation to the damper longitudinal axis 32, whereas the equalizing bore 44 extends substantially parallel in relation to the movement axis 24 of the pump piston 22. Therefore, the inflow region bore 42 issues by way of one end into the damper volume 40, whereas the equalizing bore 44 has a broken side wall by means of which it issues into the damper volume 40.

Owing to the particular arrangement of the damper volume 40, the inflow region bore 42 and the equalizing bore 44, it is possible to configure the two bores 42, 44 to be particularly short, this firstly leading to better damping of pressure pulsations and secondly also being advantageous in terms of production because these short bores require shorter processing times. In addition, it is possible to configure the cross sections of the two bores 42, 44 to be particularly large and also at any desired angles in relation to the movement axis 24, this likewise again leading to better damping properties. It is therefore advantageous when the low-pressure damper 20 is provided as a distributing element for distributing fuel in various regions of the high-pressure fuel pump 10.

What is claimed is:

1. A high-pressure fuel pump comprising:

a pump housing including a pressure chamber and a pump piston movable up and down within the pressure chamber along a movement axis; and a low-pressure damper including a damper volume arranged on the pump housing and damper elements distributed symmetrically around a damper longitudinal axis;

wherein the damper longitudinal axis is arranged at an angle of between 5° and 175° in relation to the movement axis;

wherein an intersection point between the damper longitudinal axis and the movement axis is disposed within the pressure chamber at a location within a travel of the pump piston.

2. The high-pressure fuel pump as claimed in claim 1, wherein the damper longitudinal axis is substantially perpendicular to the movement axis of the pump piston.

3. The high-pressure fuel pump as claimed in claim 1, wherein the low-pressure damper further comprises:

a damping device and a damper cover jointly defining the damper volume of the low-pressure damper; and a spacer for prestressing the damping device;

wherein the damper elements are arranged in the damper volume along the damper longitudinal axis.

4. The high-pressure fuel pump as claimed in claim 1, wherein the pump housing comprises:

an inflow region for supplying fuel to the pressure chamber; and a drive region situated opposite the pressure chamber along the movement axis of the pump piston; and drive elements for driving the pump piston arranged in said drive region;

wherein the inflow region and the drive region are fluidically connected to one another by the damper volume.

5. The high-pressure fuel pump as claimed in claim 4, wherein the pump housing includes:

an inflow region bore extending substantially parallel in relation to the damper longitudinal axis for connecting the inflow region to the damper volume; and an equalizing bore extending substantially parallel to the movement axis for connecting the drive region to the damper volume;

wherein both the inflow region bore and the equalizing bore issue into the damper volume opposite the damper cover along the damper longitudinal axis.

6. The high-pressure fuel pump as claimed in claim 1, further comprising an inlet valve arranged on the pump housing, said inlet valve having a valve axis along which a valve element moves during operation, wherein the valve axis is arranged substantially parallel to the movement axis of the pump piston.

7. The high-pressure fuel pump as claimed in claim 6, wherein the inlet valve comprises a digital inlet valve with a coil and an electrical plug-in connection;

wherein the coil and/or the electrical plug-in connection can be rotated through 360° about the valve axis.

8. The high-pressure fuel pump as claimed in claim 6, further comprising an inlet valve arranged at the inflow region.

9. The high-pressure fuel pump as claimed in claim 1, wherein the pump housing comprises a forged housing.

* * * * *